US006999054B2

(12) United States Patent
Pai

(10) Patent No.: US 6,999,054 B2
(45) Date of Patent: Feb. 14, 2006

(54) ACTIVE MATRIX DISPLAY AND DRIVING METHOD THEREOF

(75) Inventor: Feng-Ting Pai, Hsinchu (TW)

(73) Assignee: Hannstar Display Corp., Taipei (TW)

( * ) Notice: Subject to any disclaimer, the term of this patent is extended or adjusted under 35 U.S.C. 154(b) by 491 days.

(21) Appl. No.: 09/969,435

(22) Filed: Oct. 1, 2001

(65) Prior Publication Data

US 2004/0066362 A1 Apr. 8, 2004

(30) Foreign Application Priority Data

May 4, 2001 (TW) ..... 90110715 A

(51) Int. Cl.
*G09G 3/36* (2006.01)

(52) U.S. Cl. ..... 345/96; 345/92; 345/209

(58) Field of Classification Search ..... 345/87–104, 345/208–210, 204
See application file for complete search history.

(56) References Cited

U.S. PATENT DOCUMENTS 5,430,460 A * 7/1995 Takabatake et al. ..... 345/96
5,640,174 A * 6/1997 Kamei et al. ..... 345/89
5,774,099 A * 6/1998 Iwasaki et al. ..... 345/87
5,790,092 A * 8/1998 Moriyama ..... 345/96
6,177,965 B1 1/2001 Takahara et al.
6,396,468 B2 * 5/2002 Matsushima et al. ..... 345/87

FOREIGN PATENT DOCUMENTS

| | | |
|---|---|---|
| CN | 2000-193932 | 7/2000 |
| EP | 0558059 | * 9/1993 |
| JP | 10011214 | 1/1998 |
| JP | 11282431 | * 10/1999 |

* cited by examiner

*Primary Examiner*—Lun-Yi Lao
(74) *Attorney, Agent, or Firm*—Rabin & Berdo, PC

(57) ABSTRACT

A driving method for an active matrix display having a plurality of transistors, common electrodes and capacitances arranged into a matrix, wherein each of the capacitances is formed between a drain of one corresponding transistor and common electrode, is provided. The method comprises the steps of turning on the transistors in a line of the matrix, when a source of one of the turned on transistors receives a data signal of a first polarity, providing a first voltage to the corresponding common electrode, and when the source of one of the turned on transistors receives the data signal of a second polarity, providing a second voltage to the corresponding common electrode, wherein the sources of adjacent turned on transistors receive the data signals of the first and second polarity, and the first and second voltage are ground voltage references for the data signals of the first and second polarity, respectively.

10 Claims, 6 Drawing Sheets

| | | | |
|---|---|---|---|
| + | − | + | − |
| − | + | − | + |
| + | − | + | − |
| − | + | − | + |

ACTIVE MATRIX DISPLAY AND DRIVING METHOD THEREOF

BACKGROUND OF THE INVENTION

1. Field of the Invention

The present invention relates to an active matrix display, particularly to a full range active matrix display and a driving method thereof.

2. Description of the Prior Art

An active matrix display uses transistors as switching elements for pixel scanning, of which TFT LCD is a well known example. FIG. 1 is a circuit diagram of a conventional active matrix display. The conventional active matrix display comprises transistors 101 arranged into a matrix, scan lines 102 connecting the gates of the transistors in the same line of the matrix, data lines 103 connecting the sources of transistors in the same row of the matrix, common electrodes 104 corresponding to the transistors 101, capacitances 105 formed between the transistors 101 and corresponding common electrodes 104 and a driver 106.

The driver 106 generates scan signals SS to the gates of the transistors 101 through the scan lines 102 to sequentially turn on or off the transistors 101 line by line. The driver 106 also generates data signals DS to the sources of the transistors 101 through the data lines 103, wherein the capacitance 105 stores one data bit of the data signal DS on the data line 103 when the corresponding transistor 101 is turned on by the scan signal SS on the scan line 102. Thus, the data of the pixels in the matrix is stored and refreshed line by line.

In a conventional active matrix display, Dot Inversion is used to eliminate the Coupling Effect of the capacitances 105 occurring upon the switching of the transistors 101, wherein the polarities of the data signals received by the sources of the adjacent transistors 101 are opposite.

FIG. 2 is a diagram showing the characteristic curve of the data signal used for an 8-bit grayscale image. The data signal DS is a digital signal having digital values 00H~FFH represented by discrete voltage levels $V_{N1}$~$V_{Nn}$ and $V_{P1}$~$V_{Pn}$ with reference to the ground voltage reference $V_{COM}$ of the corresponding common electrode. Each of the values 00H~FFH is represented by one of the voltage levels $V_{N1}$~$V_{Nn}$ when the polarity of the data signal DS is negative, and is represented by one of the voltage levels $V_{P1}$~$V_{Pn}$ when the polarity of the data signal DS is positive.

FIG. 3 is a circuit diagram of a generator for the voltage levels $V_{N1}$~$V_{Nn}$ and $V_{P1}$~$V_{Pn}$. The generator comprises resistors $R_0$~$R_M$ connected in series. A voltage VDD is applied to the first resistor $R_0$ and the last resistor $R_M$ is connected to ground GND. The voltage levels $V_{N1}$~$V_{Nn}$ and $V_{P1}$~$V_{Pn}$ are output from the terminals between the resistors $R_0$~$R_M$.

FIG. 4 schematically shows Dot Inversion applied to an active matrix display. The squares represent where the transistors 101 are, and "+" and "−" represent the positive and negative polarity of the data signal DS received by the transistors 101. In each line of transistors 101, any two of the adjacent transistors 101 receive the data signals DS of opposite polarities.

However, in the previously described conventional active matrix display, the voltage VDD must be twice that of the highest voltage level representing the digital values of data signal DS since the VDD is cut into two halves, one half above the $V_{COM}$, for the positive data signal DS and the other half for the negative data signal DS. This increases the cost of the driving IC.

Additionally, the relationship between the voltage levels $V_N1$~$V_{Nn}$ and $V_{P1}$~$V_{Pn}$ must be $V_{P1}>V_{P2}>\ldots>V_{Pn}>V_{COM}>V_{N1}>V_{N2}>\ldots>V_{Nn}$ for the simplicity of the generator circuit. Thus, the conventional active matrix display is a Normally White system and it is difficult to switch it to a Normally Black system.

SUMMARY OF THE INVENTION

Therefore, the object of the present invention is to provide a full range active matrix display and a driving method thereof.

The present invention provides a driving method for an active matrix display having a plurality of transistors, common electrodes and capacitances arranged into a matrix, wherein each of the capacitances is formed between a drain of one corresponding transistor and common electrode. The method comprises the steps of turning on the transistors in a line of the matrix, when a source of one of the turned on transistors receives a data signal of a first polarity, providing a first voltage to the corresponding common electrode, and when the source of one of the turned on transistors, receives the data signal of a second polarity, providing a second voltage to the corresponding common electrode, wherein the sources of adjacent turned on transistors receive the data signals of the first and second polarity, and the first and second voltage are ground voltage references for the data signals of the first and second polarity, respectively.

The present invention further provides an active matrix display. The display comprises a plurality of transistors arranged into a matrix, a plurality of common electrodes corresponding to the transistors, a plurality of capacitances formed between drains of the transistor and corresponding common electrodes, and a driver turning on the transistors in a line of the matrix, when a source of one of the turned on transistors receives a data signal of a first polarity, providing a first voltage to the corresponding common electrode, and when the source of one of the turned on transistors receives the data signal of a second polarity, providing a second voltage to the corresponding common electrode, wherein the sources of adjacent turned on transistors receive the data signals of the first and second polarity, and the first and second voltage are ground voltage references for the data signals of the first and second polarity, respectively.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION OF THE INVENTION

Figure 1:
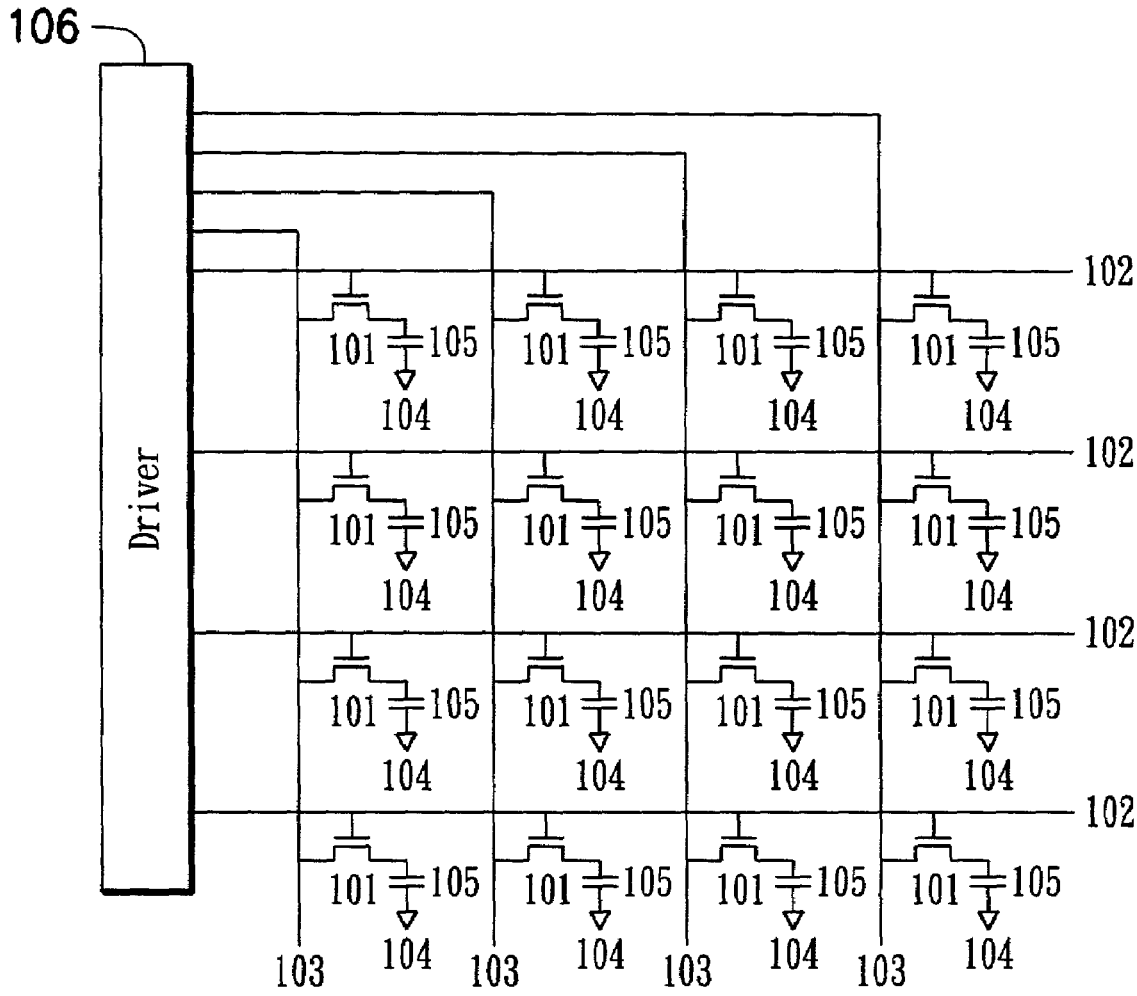
FIG. 1 (PRIOR ART)
FIG. 1 is a circuit diagram of a conventional active matrix display.
Figure 2:
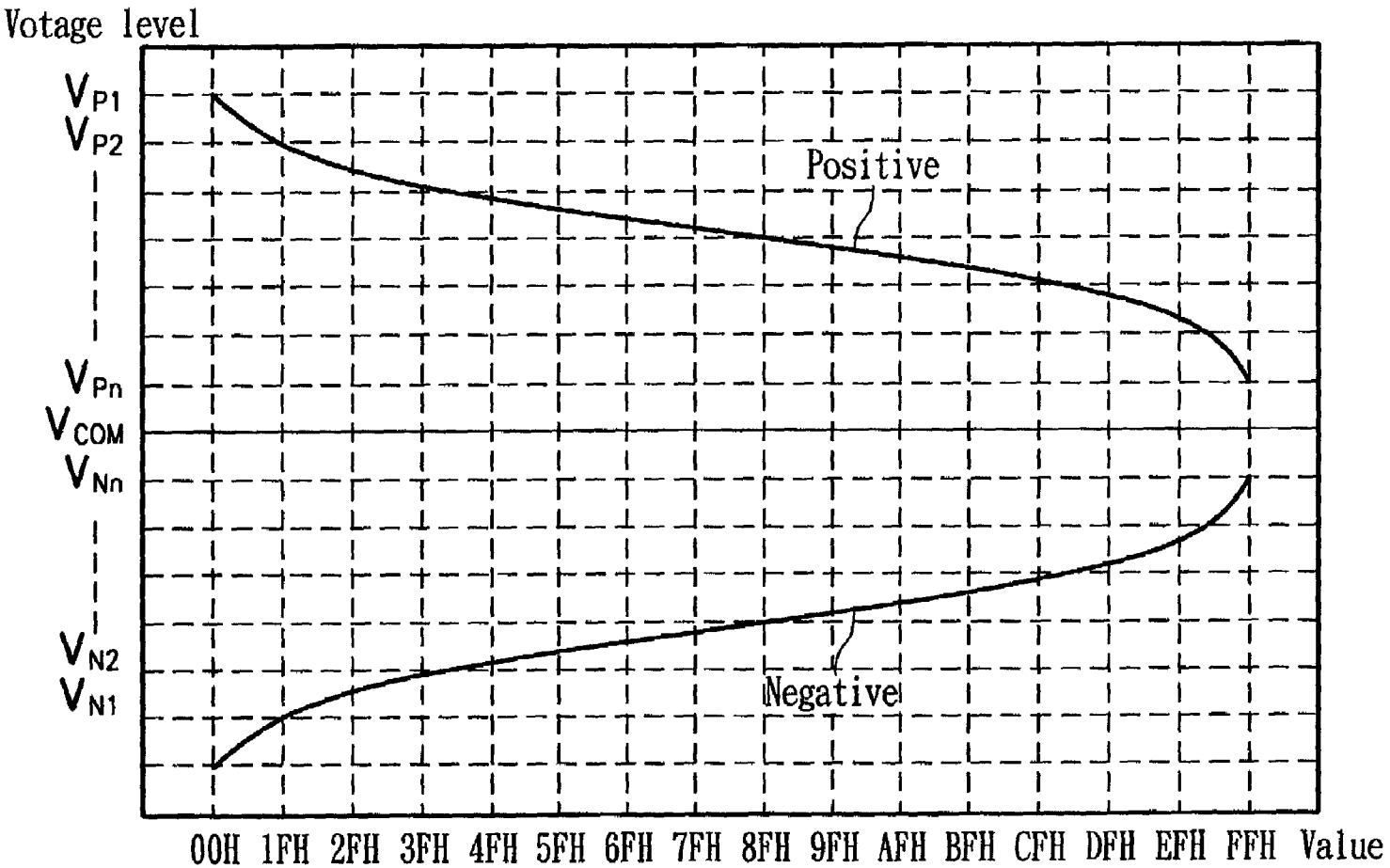
FIG. 2 (PRIOR ART)
FIG. 2 is a diagram showing the characteristic curve of the data signal used for an 8-bit grayscale image.
Figures 3, 4:
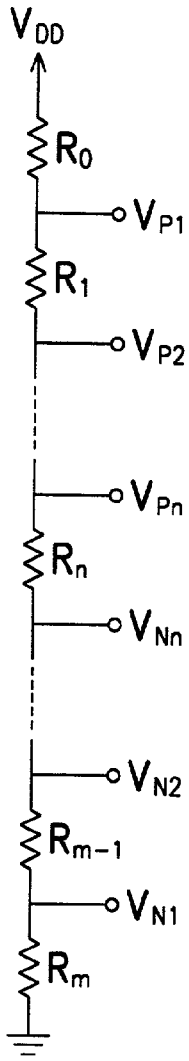
FIG. 3 (PRIOR ART)
FIG. 3 is a circuit diagram of a generator for the voltage levels $V_{N1}$~$V_{Nn}$ and $V_{P1\sim VPn}$.
FIG. 4 schematically shows Dot Inversion applied to an active matrix display.
Figure 5:
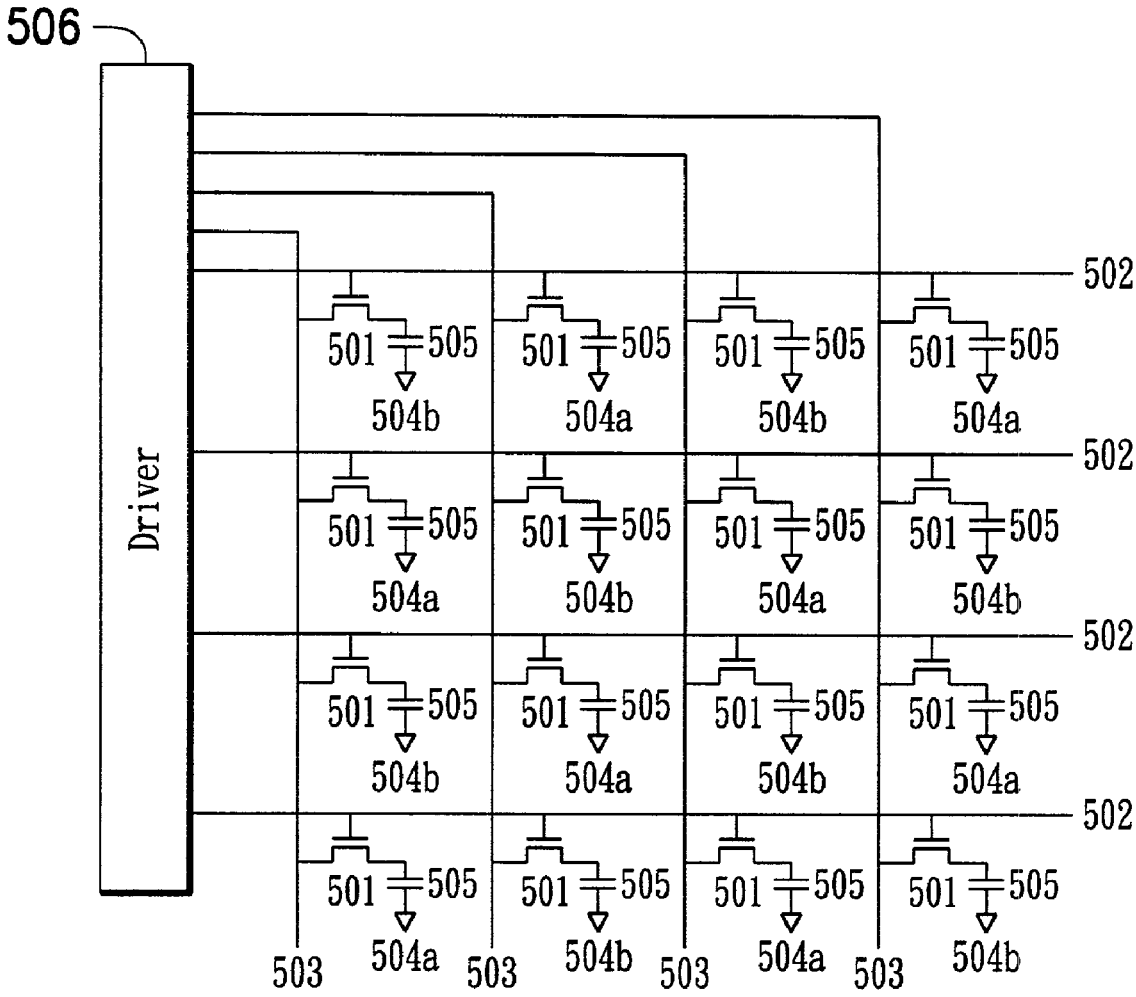
FIG. 5 is a circuit diagram of an active matrix display according to one embodiment of the invention.

FIG. 5 is a circuit diagram of an active matrix display according to one embodiment of the invention. The active matrix display comprises transistors 501 arranged into a matrix, scan lines 502 connecting the gates of the transistors in the same line of the matrix, data lines 503 connecting the sources of transistors 501 in the same row of the matrix, common electrodes 504*a* and 504*b* corresponding to the transistors 501, capacitances 505 formed between the transistors 501 and corresponding common electrodes 504*a* and 504*b*, and a driver 506.

The driver 506 generates scan signals SS to the gates of the transistors 501 through the scan lines 502 to sequentially turn the transistors 501 on or off line by line. The driver 506 also generates data signals DS to the sources of the transistors 501 through the data lines 503, wherein the capacitance 505 stores one data bit of the data signal DS on the data line 503 when the corresponding transistors 501 are turned on by the scan signal SS on the scan line 502. Thus, the data of the pixels in the matrix is stored and refreshed line by line.

With Dot Inversion, the driver 506 provides the common electrodes 504*a* and 504*b* with voltages of 0V (ground) and 9V (VDD) when the sources of the transistors 501 corresponding to the common electrodes 504*a* and 504*b* receive the data signals of positive and negative polarity, respectively. Alternatively, the driver 506 provides the common electrodes 504*a* and 504*b* with voltages of 9V and 0V when the sources of the transistors 501 corresponding to the common electrodes 504*a* and 504*b* receive the data signals of negative and positive polarity, respectively.

Figure 6:
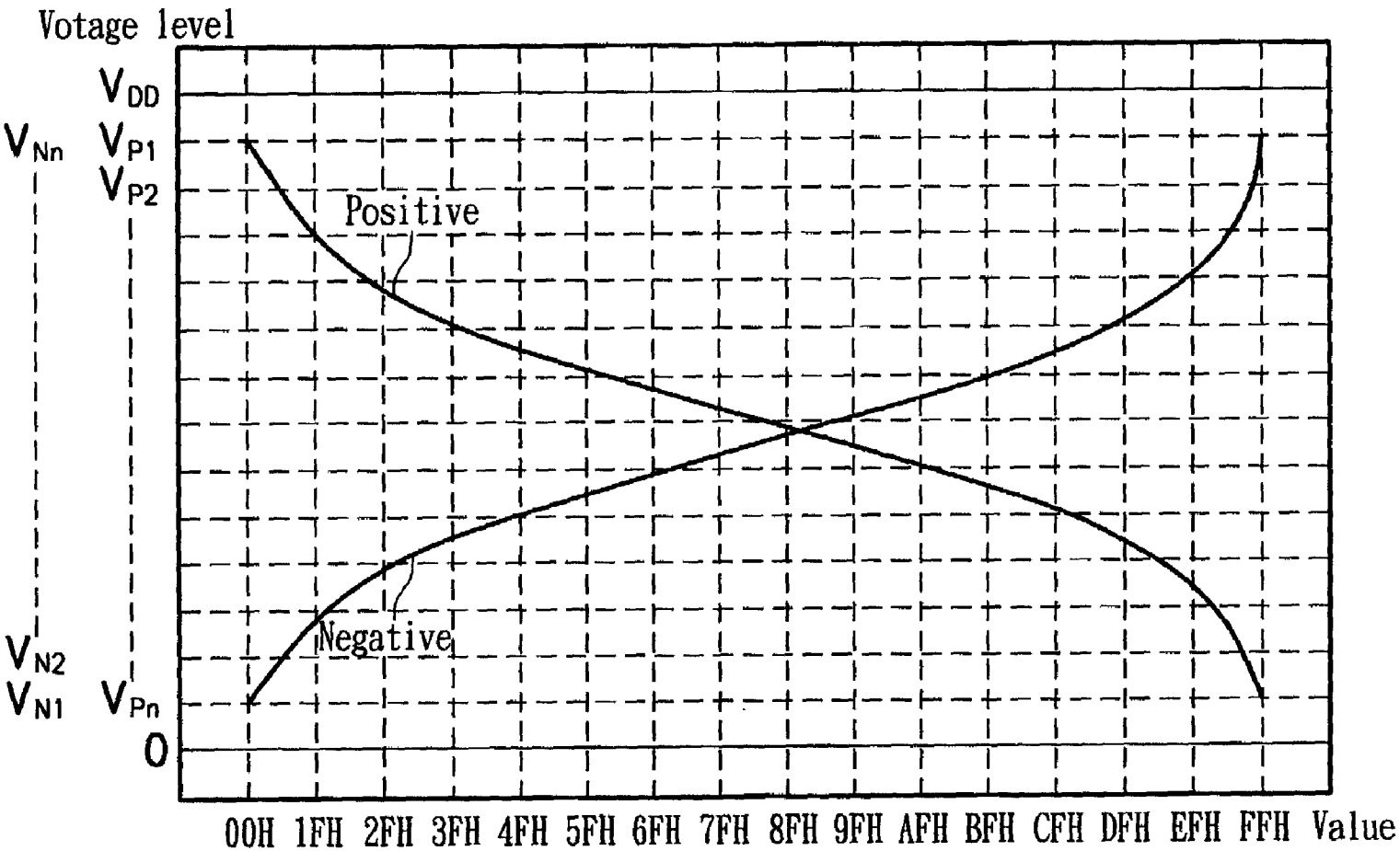
FIG. 6 is a diagram showing the characteristic curve of the data signal used for an 8-bit grayscale image according to one embodiment of the invention.

FIG. 6 is a diagram showing the characteristic curve of the data signal used for an 8-bit grayscale image according to one embodiment of the invention. The data signal DS is a digital signal having digital values 00H~FFH represented by discrete voltage levels $V'_{N1}$~$V'_{Nn}$ and $V'_{P1}$~$V'_{Pn}$. Since the common electrode voltage $V_{COM}$ (ground voltage reference) varies between VDD and 0 according to the polarity of the data signal, the ranges of the voltage levels $V'_{N1}$~$V'_{Nn}$ and $V'_{P1}$~$V'_{Pn}$ overlap and expand to the full range of VDD.

Figure 7:
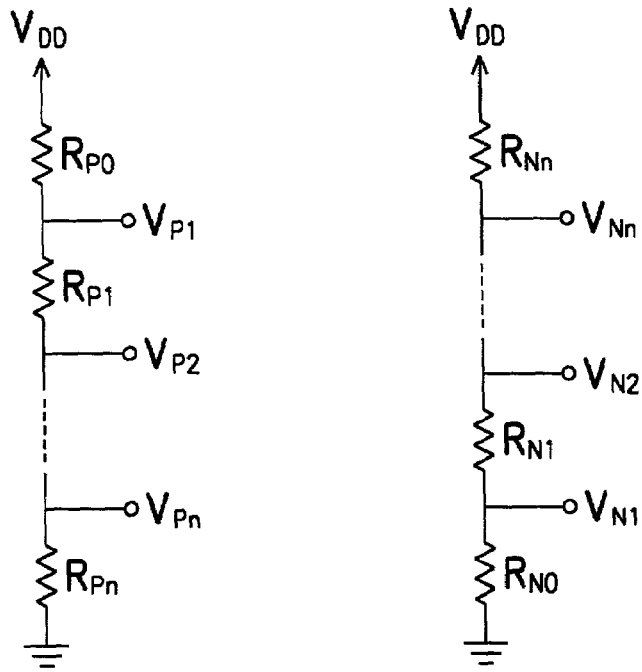
FIG. 7 is a circuit diagram of a generator according to one embodiment of the invention.

FIG. 7 is a circuit diagram of generators for the voltage levels $V'_{N1}$~$V'_{Nn}$ and $V'_{P1}$~$V'_{Pn}$. There are two generators, one for $V'_{N1}$~$V'_{Nn}$ and the other for $V'_{P1}$~$V'_{Pn}$. They comprises resistors $R_{P0}$~$R_{Pn}$ and $R_{N0}$~$R_{Nn}$ connected in series. A voltage VDD is applied to the first resistors $R_{P0}$ and $R_{Nn}$, and the last resistors $R_{Pn}$ and $R_{N0}$ are connected to ground GND. The voltage levels $V_{N1}$~$V_{Nn}$ and $V_{P1}$~$V_{Pn}$ are output from the terminals between the resistors $R_{P0}$~$R_{P1}$ and $R_{N0}$~$R_{Nn}$. Thus, the relation between $V_{N1}$~$V_{Nn}$ and $V_{P1}$~$V_{Pn}$ is not limited to that in the conventional display and it is easy to switch the display from a Normally White to Normally Black system.

Figure 8:
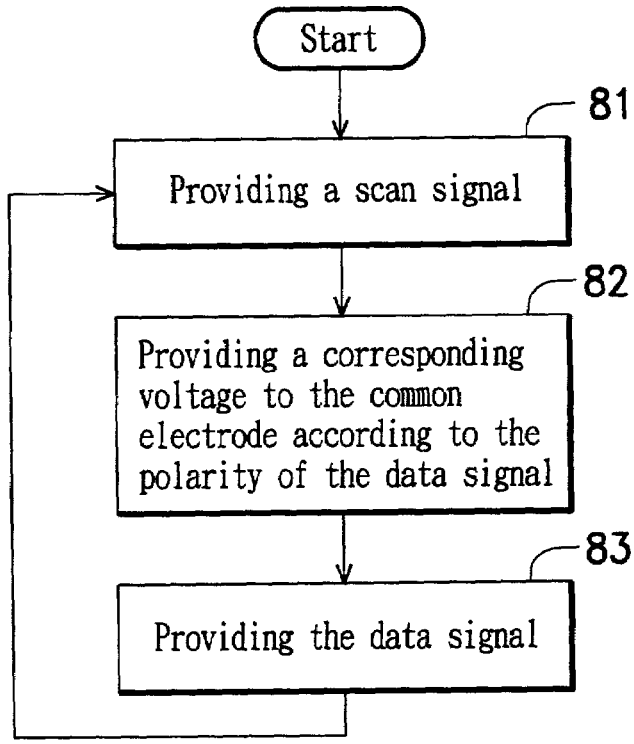
FIG. 8 is a flowchart of a driving method for an active matrix display according to one embodiment of the invention.

FIG. 8 is a flowchart of a driving method for an active matrix display according to one embodiment of the invention. The driving method is for an active matrix display having a plurality of transistors, common electrodes and capacitances arranged into a matrix, wherein each of the capacitances is formed between a drain of one corresponding transistor and common electrode.

First, in step 82, the transistors in a line of the matrix are turned on.

Second, in step 83, voltages of 0V (ground) and 9V (VDD) are provided to the common electrodes when the sources of the corresponding turned on transistors receive the data signals of positive and negative polarity, respectively. Alternatively, voltages of 9V and 0V are provided to the common electrodes when the sources of the corresponding turned on transistors receive the data signals of negative and positive polarity, respectively. Additionally, The sources of adjacent turned on transistors receive the data signals of the opposite polarities, and the voltages of 0V and 9V are ground voltage references for the positive and negative data signals, respectively.

Third, the transistors in the current line are turned off and those in a next line are turned on. Then, steps 82 and 83 are repeated so that the data of the pixels in the matrix is stored and refreshed line by line.

In conclusion, the present invention provides two isolated common electrodes. Each of the common electrode has a voltage level thereon varying with the polarity of the data signals so that the range of the voltage levels representing the digital values of the data signal expands to the full range of the VDD. This decreases the cost of the driving IC for the active matrix display.

While the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A driving method for an active matrix display having a plurality of transistors, common electrodes and capacitances arranged into a matrix, wherein each of the capacitances is formed between a drain of one corresponding transistor and common electrode, the method comprising the steps of:

turning on the transistors in a line of the matrix;

when a source of one of the turned on transistors receives a data signal of a first polarity, providing a first voltage to the corresponding common electrode; and when the source of one of the turned on transistors receives the data signal of a second polarity, providing a second voltage to the corresponding common electrode, wherein the sources of adjacent turned on transistors receive the data signals of the first and second polarity, and the first and second voltage are voltage references for the data signals of the first and second polarity, respectively, wherein one of the data signals is a digital signal having discrete voltage levels, and wherein the voltage levels are generated by at least a generator having a plurality of resistors connected in series between the first and second voltage, whereby the voltage levels are output from terminals between adjacent transistors.

2. The method as claimed in claim 1 further comprising the step of sequentially turning on the transistors line by line.

3. The method as claimed in claim 1 wherein the voltage levels are generated by two generators.

4. The method as claimed in claim 1 wherein the first voltage is 0V.

5. The method as claimed in claim 1 wherein the second voltage is 9V.

6. An active matrix display comprising:

a plurality of transistors arranged into a matrix;

a plurality of common electrodes corresponding to the transistors;

a plurality of capacitances formed between drains of the transistors and corresponding common electrodes;

a driver turning on the transistors in a line of the matrix, when a source of one of the turned on transistors receives a data signal of a first polarity, providing a first voltage to the corresponding common electrode, and when the source of one of the turned on transistors receives the data signal of a second polarity, providing a second voltage to the corresponding common electrode, wherein the sources of adjacent turned on transistors receive the data signals of the first and second polarity, and the first and second voltage are voltage references for the data signals of the first and second polarity, respectively; and at least a generator having a plurality of resistors connected in series between the first and second voltage, whereby the voltage levels are output from terminals between adjacent resistors, and wherein one of the data signals is a digital signal having discrete voltage levels.

7. The display as claimed in claim 6 wherein the driver sequentially turns on the transistors line by line.

8. The display as claimed in claim 6 wherein the voltage levels are generated by two generators.

9. The method as claimed in claim 6 wherein the first voltage is 0V.

10. The method as claimed in claim 6 wherein the second voltage is 9V.

* * * * *